US009487328B2

(12) United States Patent
Edwards et al.

(10) Patent No.: US 9,487,328 B2
(45) Date of Patent: Nov. 8, 2016

(54) COIL CRADLE

(71) Applicant: CAREGO INNOVATIVE SOLUTIONS INC., Hamilton, Ontario (CA)

(72) Inventors: Robert A. Edwards, Hamilton (CA); Ali Korabi, Hamilton (CA)

(73) Assignee: CAREGO INNOVATIVE SOLUTIONS INC., Hamilton, Ontario (CA)

( * ) Notice: Subject to any disclaimer, the term of this patent is extended or adjusted under 35 U.S.C. 154(b) by 0 days.

(21) Appl. No.: 14/598,636

(22) Filed: Jan. 16, 2015

(65) Prior Publication Data

US 2015/0197367 A1 Jul. 16, 2015

Related U.S. Application Data

(60) Provisional application No. 61/928,223, filed on Jan. 16, 2014.

(51) Int. Cl.

*B65D 85/66* (2006.01)
*A47B 81/00* (2006.01)
*B65D 19/00* (2006.01)

(Continued)

(52) U.S. Cl.

CPC ..... *B65D 19/0095* (2013.01); *A47B 81/007* (2013.01); *B65D 19/44* (2013.01); *B65D 85/04* (2013.01); *B65D 85/66* (2013.01); *B65D 2519/00024* (2013.01); *B65D 2519/00029* (2013.01); *B65D 2519/00034* (2013.01); *B65D 2519/00059* (2013.01); *B65D 2519/00064* (2013.01); *B65D 2519/00069* (2013.01); *B65D 2519/00094* (2013.01); *B65D 2519/00099* (2013.01); *B65D 2519/00104* (2013.01); *B65D 2519/00293* (2013.01); *B65D 2519/00323* (2013.01); *B65D 2519/00333* (2013.01); *B65D 2519/00562* (2013.01); *B65D 2519/00567* (2013.01); *B65D 2519/00572* (2013.01); *B65D 2519/00815* (2013.01)

(58) Field of Classification Search

CPC .. B65D 19/44; B65D 85/66; B65D 71/0096; B65D 2519/00293; B65D 2519/00298; B65D 2519/00273; B65D 2519/00333; A47B 81/007

USPC ..... 248/346.02, 346.01; 206/391; 108/55.3, 108/55.1, 57.17, 57.19, 57.33

See application file for complete search history.

(56) References Cited

U.S. PATENT DOCUMENTS 4,382,733 A * 5/1983 Rodgers ..... B65D 19/0095 108/55.3
4,796,540 A * 1/1989 Pelfrey ..... B65D 19/0016 108/53.1

(Continued)

FOREIGN PATENT DOCUMENTS

FR 2231575 A1 * 12/1974

*Primary Examiner* — Ryan Kwiecinski

(74) *Attorney, Agent, or Firm* — Young Basile Hanlon & MacFarlane, P.C.

(57) ABSTRACT

In an aspect of the invention, there is provided a coil cradle for supporting a coil over a floor. The coil cradle comprises one or more pairs of opposing coil wedges secured to a support structure. Each coil wedge has a support surface for supporting the coil thereupon. The wedges in each pair of wedges are arranged such that their support surfaces and the support structure form a valley within which the coil is supported in use. In use, the support surface of each coil wedge is oriented at approximately 14° to horizontal.

8 Claims, 7 Drawing Sheets

(51) Int. Cl.
*B65D 19/44* (2006.01)
*B65D 85/04* (2006.01)

(56) References Cited

U.S. PATENT DOCUMENTS 5,413,054 A * 5/1995 Collins ..... B65D 19/44 108/55.3
5,425,314 A * 6/1995 MacFarland ..... B65D 19/0012 108/51.3
5,515,977 A * 5/1996 Lambert ..... B65D 85/66 206/395
5,769,376 A * 6/1998 Bostic ..... B65D 85/66 108/55.1
5,884,885 A * 3/1999 Schmidt, Jr. ..... B63B 23/62 114/259
5,931,435 A * 8/1999 Hoadley ..... B65D 19/44 108/55.3
6,142,440 A * 11/2000 Gratz ..... B65D 85/66 108/51.11
6,231,284 B1 * 5/2001 Kordel ..... B65D 19/44 108/55.3
6,550,741 B1 * 4/2003 Cottone ..... B60P 7/12 108/51.11
7,458,553 B2 * 12/2008 Tzur ..... B65D 19/44 248/346.02
8,348,563 B2 * 1/2013 Buxton ..... B60P 7/12 410/50
8,726,816 B2 * 5/2014 Servaes ..... B65D 19/0038 108/55.3
2012/0097670 A1 * 4/2012 Edwards ..... B65D 85/66 220/1.5
2015/0097098 A1 * 4/2015 Chi ..... B65H 49/38 248/346.5

* cited by examiner

COIL CRADLE

This application claims priority to U.S. Provisional Patent Application Ser. No. 61/928,223, filed Jan. 16, 2014.

FIELD

The present invention relates to coil cradles of the type used in coil storage facilities, such as of the type described in U.S. Provisional Patent Application Ser. No. 61/721,865, incorporated herein by reference.

BACKGROUND

Coils (such as steel coils) are typically stored in coil storage facilities upon coil cradles. However, coil cradles are not often capable of accommodating a wide range of outside diameters (OD) of coils while maintaining a compact footprint so as to permit efficient storage of many coils within the storage facility.

SUMMARY OF THE INVENTION

Forming one aspect of the invention is a coil cradle having a valley with opposing surfaces for supporting a coil. In use, each surface is oriented at about 14° to horizontal.

Forming another aspect of the invention is a coil cradle for supporting a coil over a floor. The coil cradle comprises one or more pairs of opposing coil wedges secured to a support structure. Each coil wedge has a support surface for supporting the coil thereupon. The wedges in each pair of wedges are arranged such that their support surfaces and the support structure form a valley within which the coil is supported in use. In use, the support surface of each coil wedge is oriented at approximately 14° to horizontal.

Forming another aspect of the invention is a coil cradle for supporting a coil over a floor. The coil cradle comprises four pairs of opposing and generally aligned coil wedges secured to a support structure. Each coil wedge has a support surface for supporting the coil thereupon. The pairs of opposing coil wedges are spaced apart from and arranged generally parallel to each other. The support structure includes three spaced cross members above and secured to four spaced skid members. Each coil wedge in each pair of opposing coil wedges is separated by and abuts a middle of the three spaced cross members. Each skid member runs underneath and parallel to each pair of opposing coil wedges. The wedges in each pair of wedges are arranged such that their support surfaces and the middle cross member form a valley within which the coil is supported in use. The middle cross member includes a centrally disposed hole providing a line of sight through the coil cradle. In use, the support surface of each coil wedge is oriented at approximately 14° to horizontal.

Further aspects of the invention will become apparent from the following description taken together with the accompanying drawings, the latter being briefly described hereinafter.

DETAILED DESCRIPTION

Figure 1:
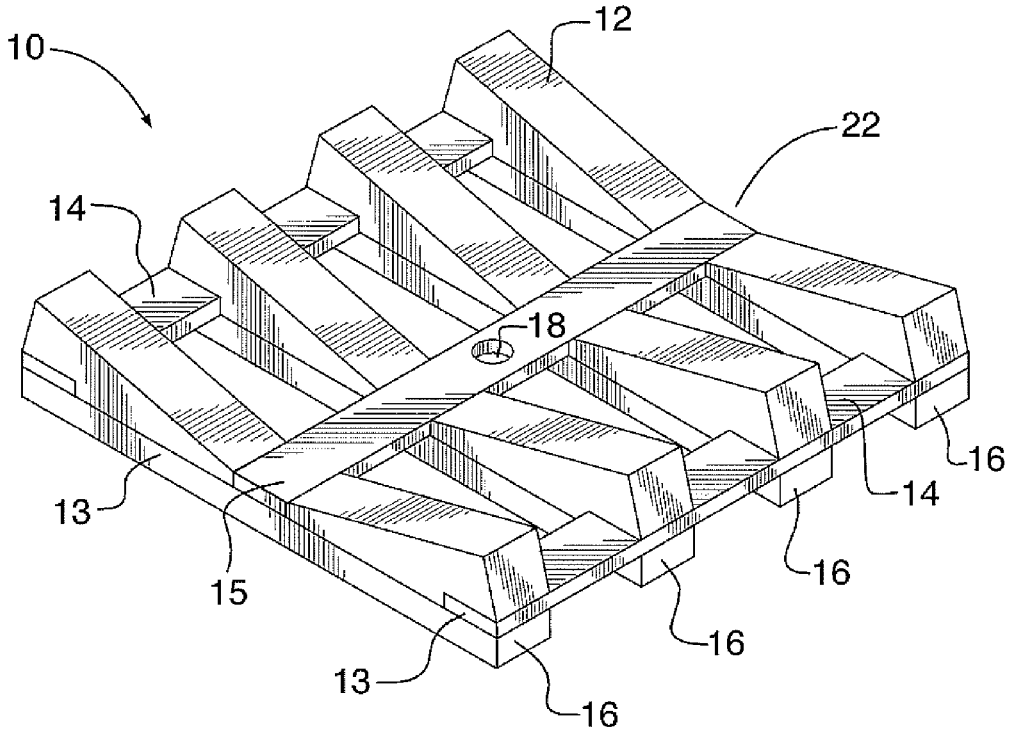
FIG. 1 is an upper perspective view of a coil cradle constructed in accordance with an embodiment of the present invention.

Referring to FIGS. 1 to 17, a coil cradle for supporting thereupon a coil and constructed in accordance with an embodiment of the invention is noted generally by reference numeral 10.

Figure 17:
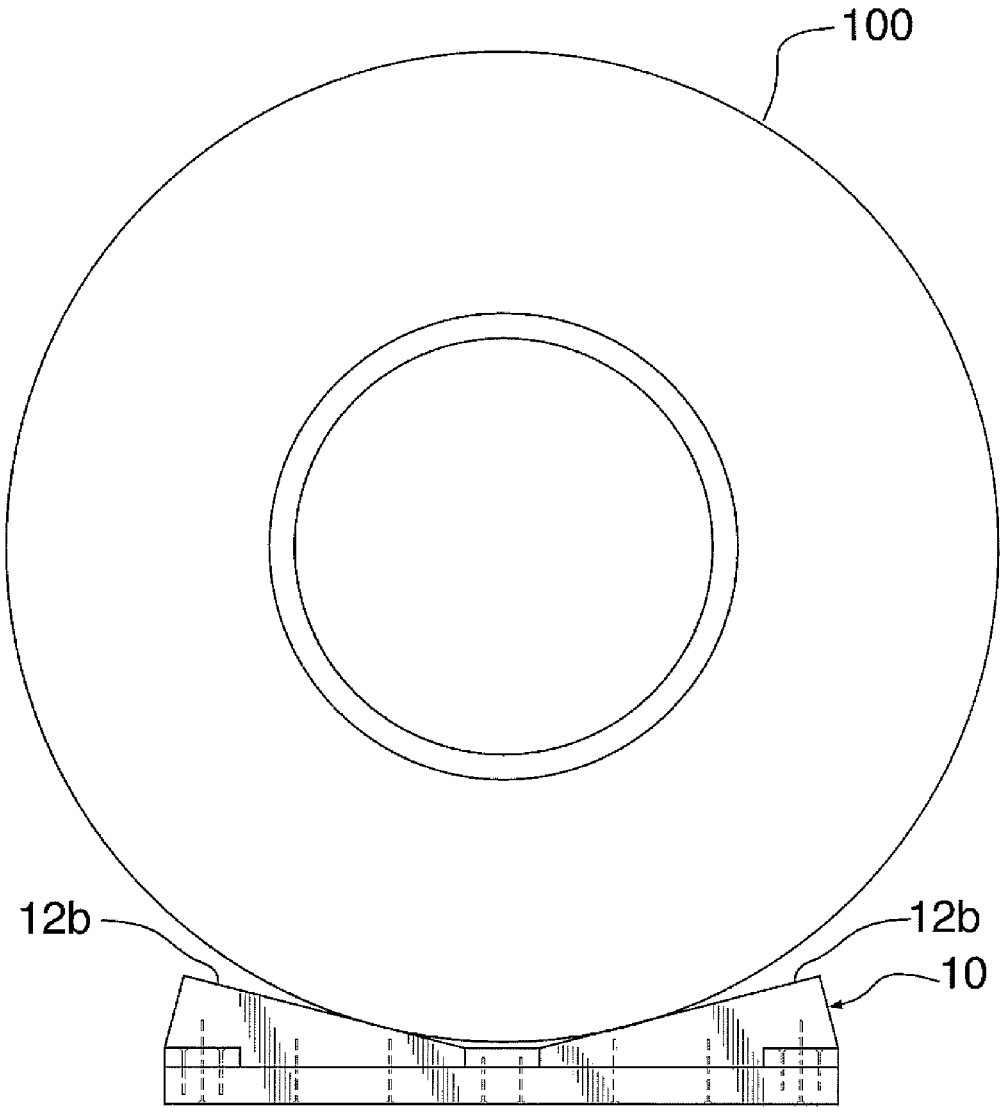
FIG. 17 shows the coil cradle of FIG. 1 with a coil thereupon.

In the exemplary embodiment, coil cradle 10 includes four pairs of opposing and generally aligned coil wedges 12, each having a support surface 12*b* for supporting a coil 100 thereupon. The pairs of opposing coil wedges are spaced apart from and arranged generally parallel to each other. The wedges 12 are secured to a support structure 13 consisting of three spaced apart cross members secured to four spaced apart skid members 16. The cross members include outer cross members 14 and middle cross member 15. The skid members are disposed perpendicularly to the cross members, and each skid member 16 runs underneath each pair of coil wedges 12, as shown in FIGS. 1 to 4 and 17. The wedges 12 in each pair of wedges are arranged such that their support surfaces 12*b* form, with middle cross member 15, valley 22. In use, coil 100 is supported over a floor within the valley 22 by contact with at least support surfaces 12*b*, as shown in FIG. 17. Depending on the outside diameter (OD) of coil 100, the coil may also contact middle cross member 15 when at rest within valley 22.

The wedges 12, cross members 14, 15 and skid members 16 are all fixedly secured to each other, such as by glue, nails, screws through bore or pilot holes 20, and so on. The pilot holes 20 need not be utilized, and depict also the general placement of nails in instances where nails are used. In the exemplary embodiment, the cross members 14, 15 and skid members 16 are made of hard wood timber, which facilitates the assembly of the coil cradle using nails and/or screws. It will be appreciated that other hard materials may be utilized, such as plastic, metal, and so on.

Figure 3:
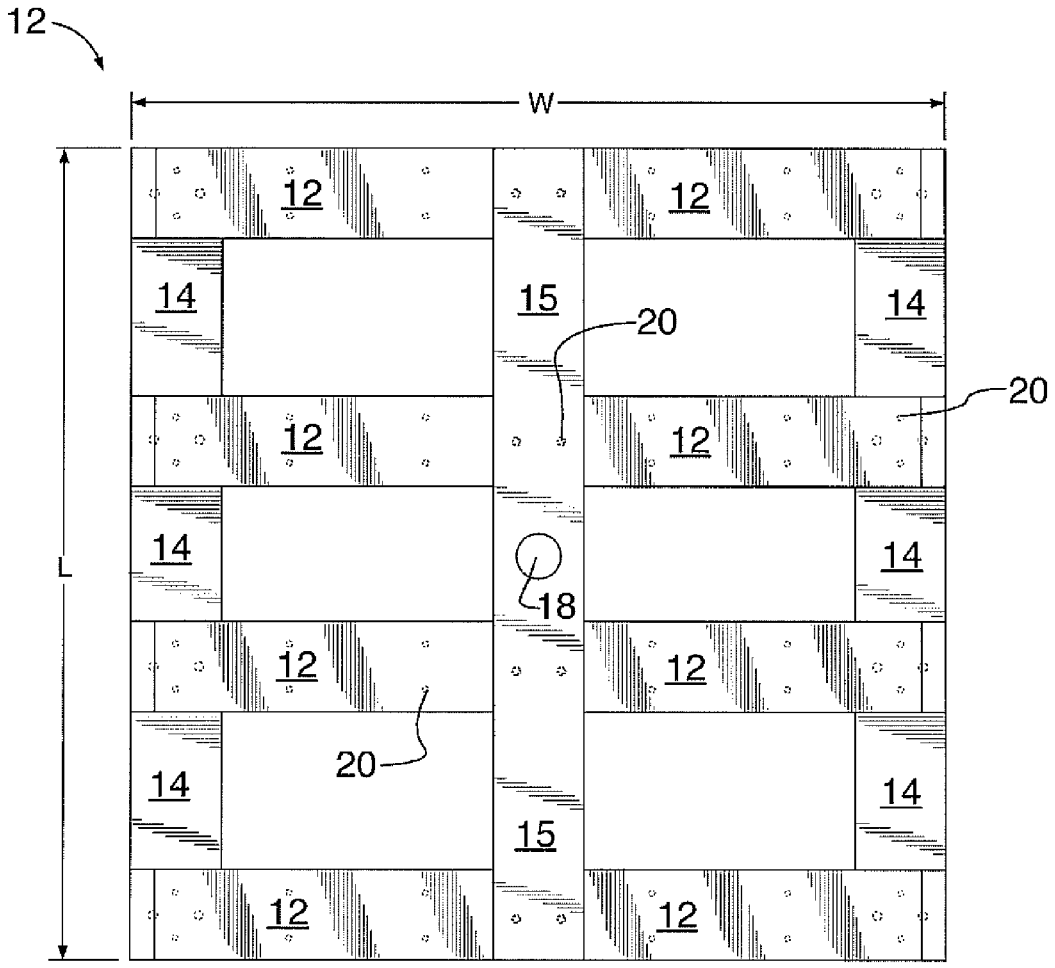
FIG. 3 is a top view of the coil cradle shown in FIG. 1.
Figure 4:
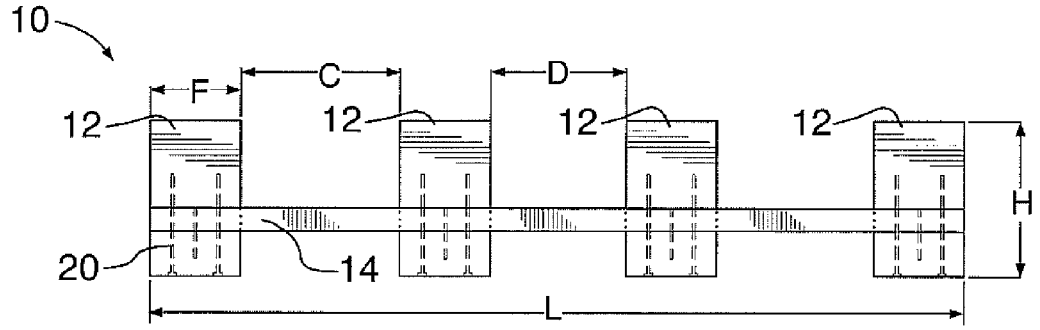
FIG. 4 is a side view of the coil cradle shown in FIG. 1.

The middle cross member 15 may include hole 18 such that hole is substantially centrally disposed on coil cradle 10. In such embodiments, hole 18 provides a line of sight through the cradle 10, permitting a view from above the coil cradle, through the coil cradle to the floor beneath it, as shown in FIGS. 1 and 3.

With reference to the figures, in the exemplary embodiment, coil cradle 10 has the following approximate dimensions: A=14°;B=16 inches; C=7 inches; D=6 inches; E=15.5 inches; F=4 inches; G=12 inches; H=6.75 inches; I=1 inch; J=1 inch; K=4 inches; L=36 inches; M=2 inches; N=5 inches; O=2 inches; P=2 inches; Q=4 inches; R=2 inches; S=11 inches; T=10 inches; U=1 inch; V=2 inches; W=36 inches; X=1 inch; and Y=15.75 inches. Within the exemplary embodiment, dimensions pertaining to the placement of pilot holes 20 may be changed. The number of pilot holes 20 used may also be varied, and further, pilot holes 20 may be entirely omitted.

The exemplary embodiment is therefore compact, with an overall dimension of approximately 36 inches×36 inches. Further, outer sloped surface 12*a* of coil cradle 10 is steeply sloped, as clearly shown in FIG. 2. This allows for adjacent cradles to be compactly arranged in a coil storage facility (where the coils 100 do not extend beyond the edges of the cradle), resulting in more efficient coil storage.

Figure 2:
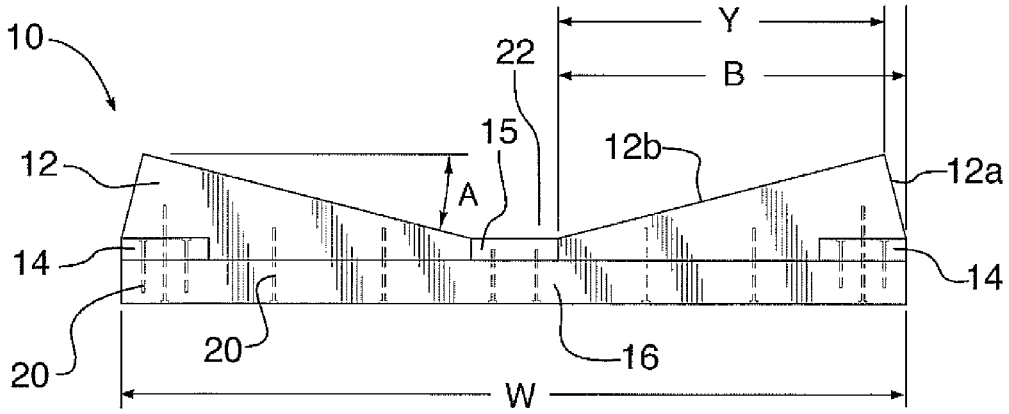
FIG. 2 is a front view of the coil cradle shown in FIG. 1.

In the exemplary embodiment, the support surfaces 12*b* of the wedges are arranged, in use, 14° to horizontal, as shown by angle A in FIG. 2. In this arrangement, coil cradle 10 may support a wider range of coil outside diameters (OD) than prior coil cradles.

It will be appreciated that, depending on the size of the coil storage facility and/or the coils, the coil cradle 10 may be constructed in other generally proportionate dimensions, and may contain fewer or more pairs of opposing coil wedges 12 (and, accordingly, skid members 16).

Figure 5:
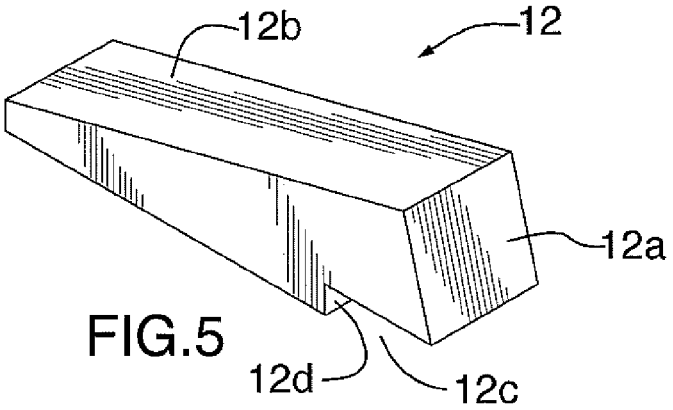
FIG. 5 is an upper perspective view of a coil wedge of the coil cradle shown in FIG. 1.
Figure 6:
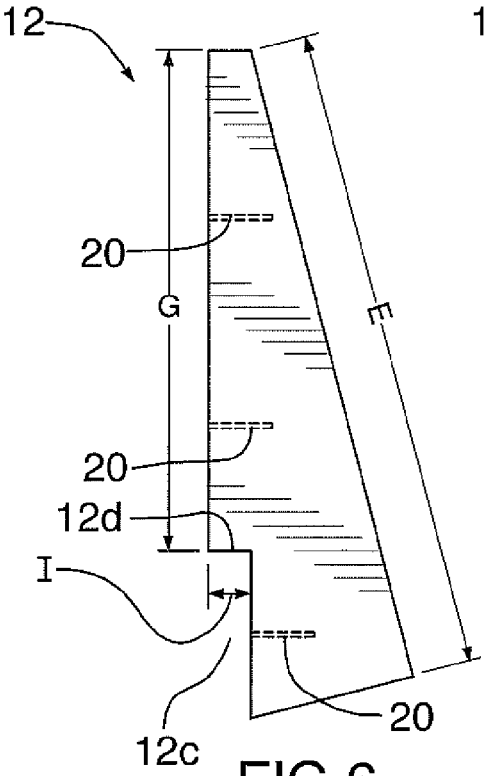
FIG. 6 is a front view of the coil wedge shown in FIG. 5.
Figure 7:
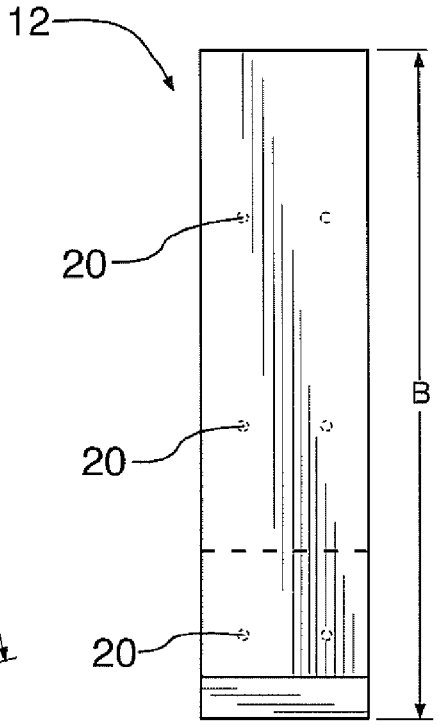
FIG. 7 is a top view of the coil wedge shown in FIG. 5.
Figure 8:
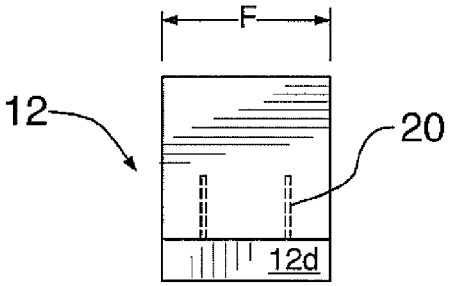
FIG. 8 is a side view of the coil wedge shown in FIG. 5.
Figure 9:
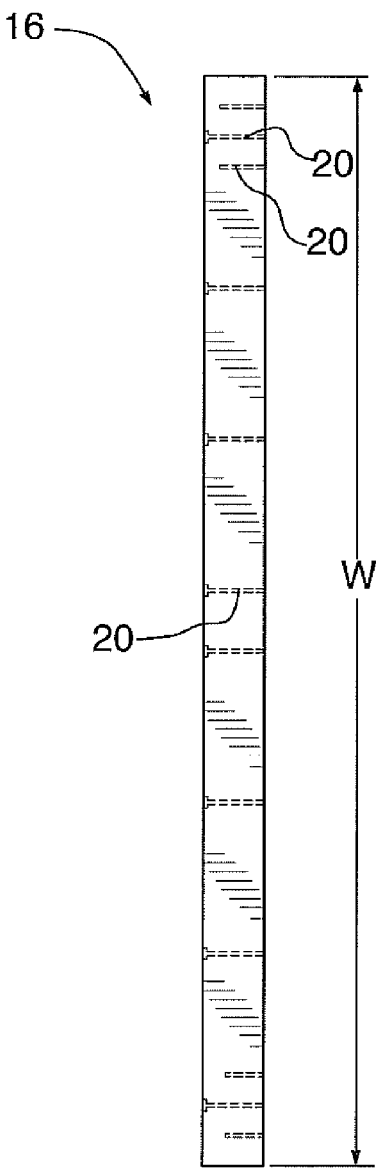
FIG. 9 is a front view of a skid member of the coil cradle shown in FIG. 1.
Figure 10:
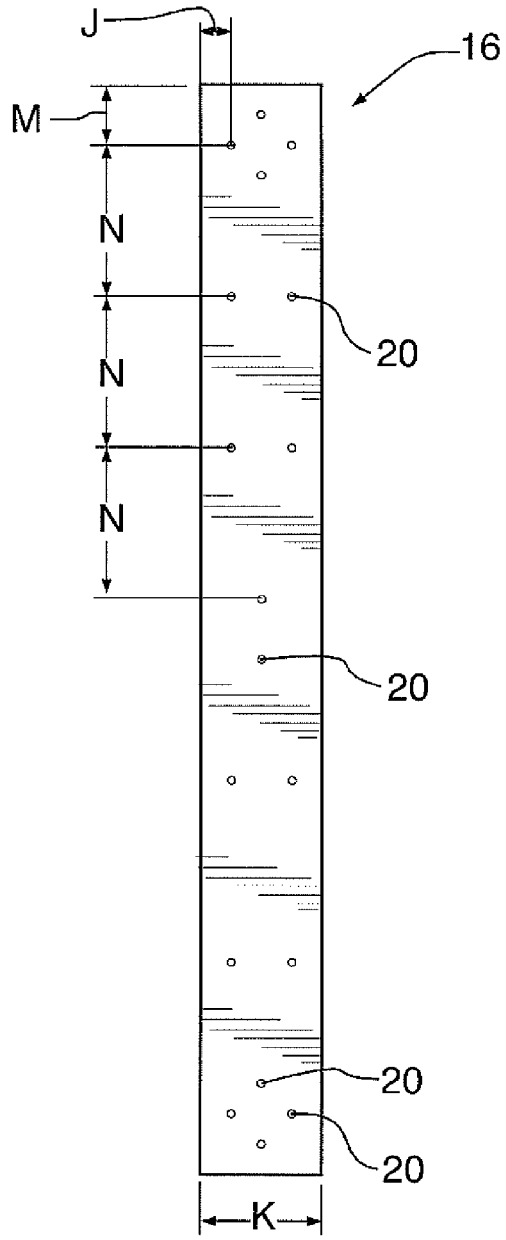
FIG. 10 is a top view of the skid member shown in FIG. 9.
Figure 11:
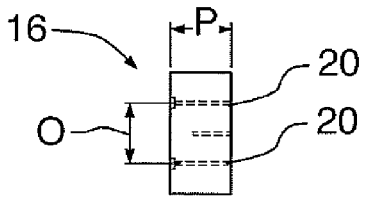
FIG. 11 is a side view of the skid member shown in FIG. 9.
Figure 12:
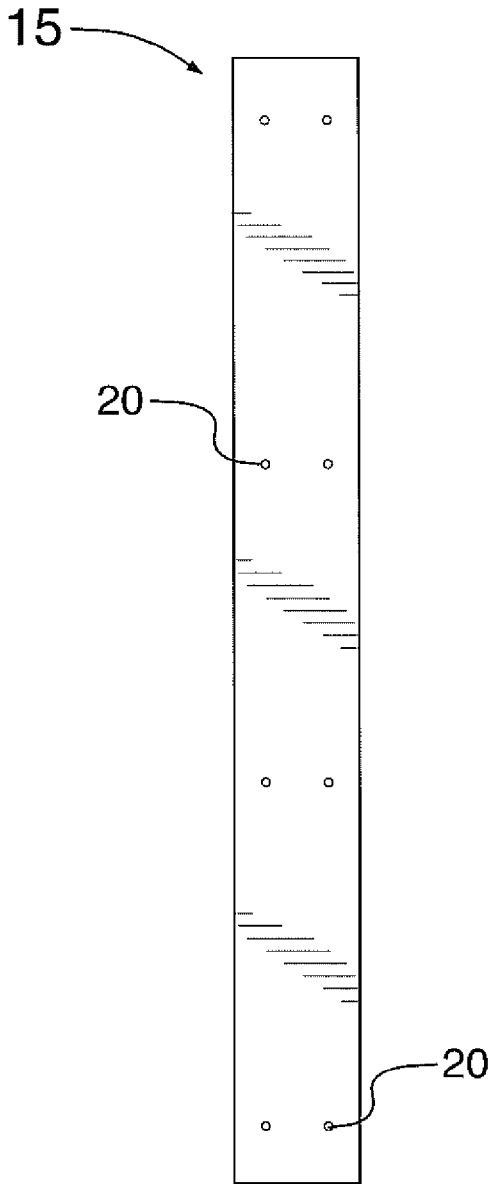
FIG. 12 is a bottom view of a middle cross member of the coil cradle shown in FIG. 1.
Figure 13:
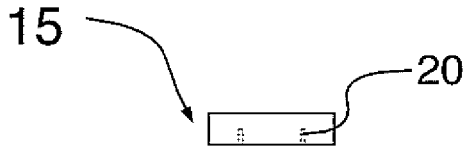
FIG. 13 is a front view of the middle cross member shown in FIG. 12.
Figure 14:
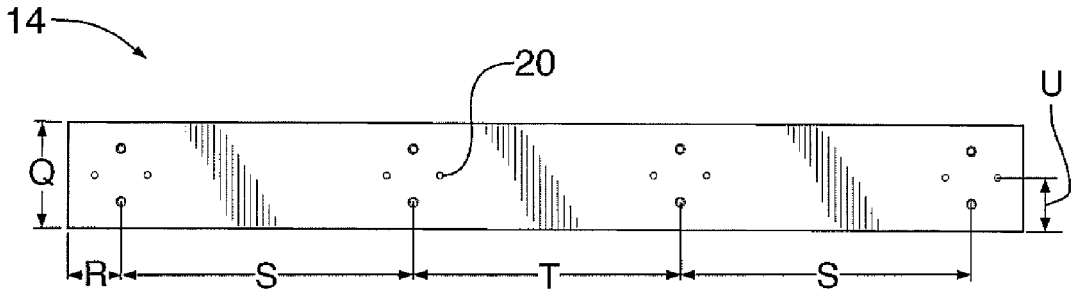
FIG. 14 is a top view of an outer cross member of the coil cradle shown in FIG. 1.
Figure 15:
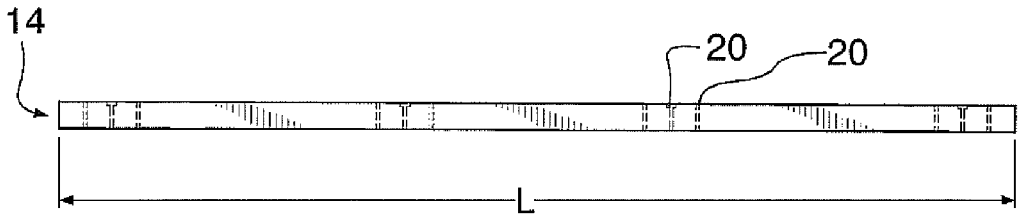
FIG. 15 is a side view of the outer cross member shown in FIG. 14.
Figure 16:
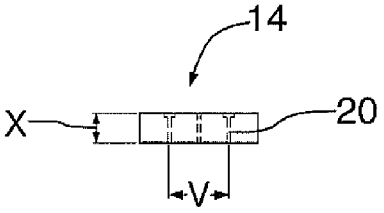
FIG. 16 is a front view of the outer cross member shown in FIG. 14.

Referring to FIGS. 5, 6 and 8, in the exemplary embodiment, each wedge 12 includes stepped portion 12*c* which is sized and dimensioned for co-operable engagement with one of the outer cross members 14, as shown in FIGS. 1, 2 and 17. It is expected that when coil 100 is at rest atop coil cradle 10, the outward lateral force imposed on the angled wedges 12 by the coil 100 would be counteracted in part by the abutting engagement between the wedges 12 and the outer cross members 14 (which are also fixedly secured to the skid members 16 and the wedges 12, as previously described) at stepped surfaces 12*d* of the stepped portions 12*c*.

It is to be understood that what has been described are specific embodiments of the invention. The scope of the claims should not be limited by the embodiments set forth above, but should be given the broadest interpretation consistent with the description as a whole.

The invention claimed is:

1. A coil cradle for supporting a coil over a floor, the coil cradle comprising:

four pairs of opposing and generally aligned coil wedges secured to a support structure, each coil wedge having a support surface for supporting the coil thereupon, said pairs of opposing coil wedges spaced apart from and arranged generally parallel to each other, said support structure including three spaced cross members above and secured to four spaced skid members, each said coil wedge in each said pair of opposing coil wedges being separated by and being engaged with an upright surface of a middle cross member of said three spaced cross members, one of the coil wedges of each said pair of opposing coil wedges being engaged with an upright surface of one of two outer cross members of said three spaced cross members, and each skid member running underneath and parallel to each of the coil wedges of one of the pairs of opposing coil wedges, wherein the wedges in each pair of wedges are arranged such that the support surfaces thereof and said middle cross member form a valley, the wedges being configured to support the coil within the valley.

2. The coil cradle of claim 1, wherein said middle cross member includes a centrally disposed hole providing a line of sight through said coil cradle.

3. The coil cradle of claim 1, wherein the support surface of each said coil wedge is oriented at approximately 14 degrees to horizontal.

4. The coil cradle of claim 1, wherein a common plane extends through each of the coil wedges, the middle cross member, and the two outer cross members.

5. The coil cradle of claim 1, wherein each outer member is configured to apply a normal force against each coil wedge engaged therewith in response to an outward lateral force imposed by the coil on the coil wedges.

6. The coil cradle of claim 1, wherein the middle cross member and the two outer cross members are distinct members of the support structure, each outer cross member being secured to one coil wedge of each pair of opposing coil wedges.

7. A coil cradle comprising:

a support structure comprising:

two outer cross members extending parallel with each other, and a plurality of coil wedge members, each coil wedge member including an upper support surface and an outer surface, the upper support surfaces cooperatively defining a valley, and each outer surface being engaged with one of the two outer cross members; and a plurality of skid members extending parallel with each other and perpendicular to the outer cross members, each skid member running underneath one of the coil wedge members and being secured to each outer cross member;

wherein the plurality of coil wedge members are configured to support a coil within the valley, and each outer cross member is configured to apply a normal force in an inward lateral direction against each coil wedge member engaged therewith in response to an outward lateral force imposed by the coil on the coil wedge; and wherein support structure further comprises a middle cross member extending parallel with the two outer cross members, each coil wedge member having an inner surface engaged with the middle cross member, wherein the middle cross member and the two outer cross members are distinct members of the support structure, and the coil wedge members are distinct members from the support structure.

8. The coil cradle of claim 7, wherein a common plane extends through each coil wedge member, and each outer cross member.

* * * * *